US008172086B2

(12) United States Patent
Aldridge et al.

(10) Patent No.: US 8,172,086 B2
(45) **Date of Patent: *May 8, 2012**

(54) PACKAGING DESIGN WITH SEPARATE COMPARTMENTS

(75) Inventors: Allen S. Aldridge, South Orange, NJ (US); Paul K. Bowers, Long Valley, NJ (US); Dan Devine, Rockton, IL (US); Christopher J. Feltman, Rockton, IL (US); Frank Schiro, Doylestown, PA (US)

(73) Assignee: Cadbury Adams USA LLC, Parsippany, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/985,747

(22) Filed: Jan. 6, 2011

(65) Prior Publication Data

US 2011/0101079 A1 May 5, 2011

Related U.S. Application Data

(63) Continuation of application No. 12/713,359, filed on Feb. 26, 2010, now Pat. No. 7,913,846, which is a continuation of application No. 12/113,341, filed on May 1, 2008, now Pat. No. 7,686,165, which is a continuation of application No. 11/111,523, filed on Apr. 21, 2005, now Pat. No. 7,569,008, which is a continuation of application No. 11/025,739, filed on Dec. 22, 2004, now Pat. No. 7,159,717.

(60) Provisional application No. 60/570,004, filed on May 11, 2004, provisional application No. 60/570,015, filed on May 11, 2004, provisional application No. 60/576,122, filed on Jun. 2, 2004.

(51) Int. Cl.
*B65D 85/48* (2006.01)

(52) U.S. Cl. ..... 206/449; 206/37; 206/460; 206/800; 229/87.07

(58) Field of Classification Search ..... 206/37–39, 206/256, 264, 443, 472, 474, 449, 460, 784, 206/800; 229/87.05, 87.07, 120.01, 120.09, 229/120.011, 149; 426/106, 115, 120
See application file for complete search history.

(56) References Cited

U.S. PATENT DOCUMENTS 183,466 A 10/1876 Pearl
(Continued)

FOREIGN PATENT DOCUMENTS

BE 417615 10/1936
(Continued)

OTHER PUBLICATIONS

Mintel gnpd. Mr. Brown Chewing Gum, Product Description. p. 1. http://www.gnpd.com. Feb. 7, 2000.

*Primary Examiner* — Luan K Bui
(74) *Attorney, Agent, or Firm* — Marsh Fischmann & Breyfogle LLP

(57) ABSTRACT

A gum packaging design that utilizes two separate compartments, an upper compartment and a lower compartment. Each of the compartments may be formed from a separate paperboard blank. The blanks are folded to form the compartments and then the lower compartment is adhered to the upper compartment in a fashion that allows the lower compartment to be later separated therefrom by tearing along a perforation after the lower compartment is emptied. A cover flap on the upper compartment can be used to hold the package in a compact, closed position by folding the compartments to face each other and tucking an end into a receiving slot formed in the back panel of the lower compartment. Once the lower compartment is separated from the upper compartment, the same cover flap can be used to close the remaining package by tucking the same end of the cover flap into a receiving slot formed in a front panel of the upper compartment.

11 Claims, 5 Drawing Sheets

U.S. PATENT DOCUMENTS

| | | | | |
|---|---|---|---|---|
| 271,580 | A | | 1/1883 | Jones |
| 276,171 | A | | 4/1883 | Fraser |
| 329,134 | A | | 10/1885 | Brotz |
| 437,042 | A | * | 9/1890 | Peck ..... 229/120.09 |
| 528,186 | A | | 10/1894 | Strakosch |
| 603,872 | A | | 5/1898 | Bucklin |
| 624,583 | A | | 5/1899 | Vierengel |
| 656,349 | A | | 8/1900 | Hilson |
| 732,844 | A | * | 7/1903 | Gerbereux ..... 229/120.09 |
| 924,275 | A | | 6/1909 | Richardson |
| 1,037,218 | A | | 9/1912 | Dirnberger |
| 1,096,909 | A | | 5/1914 | Harvey |
| 1,132,781 | A | | 3/1915 | Lile |
| 1,144,559 | A | | 6/1915 | Mendelson et al. |
| 1,193,423 | A | | 8/1916 | Pryor |
| 1,216,259 | A | | 2/1917 | Armstrong |
| 1,253,219 | A | | 1/1918 | Dula |
| 1,256,965 | A | | 2/1918 | Williams |
| 1,275,904 | A | | 8/1918 | Grotta |
| 1,320,287 | A | | 10/1919 | Stern |
| 1,382,459 | A | | 6/1921 | Bercovici |
| 1,432,932 | A | | 10/1922 | Weis |
| 1,433,439 | A | | 10/1922 | Weis |
| 1,469,080 | A | | 9/1923 | Goerk |
| 1,490,529 | A | | 4/1924 | Dittgen |
| 1,550,966 | A | | 8/1925 | Kappes |
| 1,575,420 | A | | 3/1926 | Eisenstark et al. |
| 1,589,118 | A | | 6/1926 | Cowen |
| 1,625,651 | A | | 3/1928 | Gretsch |
| 1,662,028 | A | | 3/1928 | Gold et al. |
| 1,666,095 | A | | 4/1928 | Jackson |
| 1,683,651 | A | | 9/1928 | Bovard |
| 1,684,381 | A | | 9/1928 | Bahr |
| 1,735,325 | A | | 11/1929 | L'Enfant |
| 1,751,208 | A | | 3/1930 | Kappes |
| 1,755,579 | A | | 4/1930 | Grupe |
| 1,763,763 | A | | 7/1930 | Denmead |
| 1,822,491 | A | | 3/1931 | Molins |
| 1,805,417 | A | | 5/1931 | Ritzel |
| 1,805,418 | A | | 5/1931 | Ritzel |
| 1,806,905 | A | | 5/1931 | Kampfman |
| 1,842,891 | A | | 1/1932 | Allen |
| 1,854,849 | A | | 4/1932 | Lerch |
| 1,863,190 | A | | 6/1932 | Coulapides |
| 1,864,493 | A | | 6/1932 | Bombard et al. |
| 1,865,535 | A | | 7/1932 | Meany |
| 1,866,323 | A | | 7/1932 | Russell |
| 1,867,949 | A | | 7/1932 | Molins |
| 1,870,299 | A | | 8/1932 | Strlelitz |
| 1,871,426 | A | | 8/1932 | Schmitt |
| 1,875,196 | A | | 8/1932 | Molins |
| 1,875,197 | A | | 8/1932 | Molins |
| 1,883,852 | A | | 10/1932 | Medoff |
| 1,895,233 | A | | 1/1933 | Rossen |
| 1,906,742 | A | | 5/1933 | Coulapides |
| 1,929,148 | A | | 10/1933 | Molins et al. |
| 1,943,204 | A | | 1/1934 | Chute |
| 2,008,168 | A | | 7/1935 | Bergstein |
| 2,008,361 | A | | 7/1935 | Lindsey |
| 2,031,011 | A | | 2/1936 | Solon |
| 2,032,661 | A | | 3/1936 | Linker |
| 2,039,491 | A | | 5/1936 | Nolan |
| 2,042,073 | A | | 5/1936 | Rose |
| 2,046,484 | A | | 7/1936 | Ringler |
| 2,049,124 | A | | 7/1936 | Linderman |
| 2,074,451 | A | * | 3/1937 | Berberian ..... 206/256 |
| 2,085,728 | A | | 7/1937 | Clark |
| 2,117,281 | A | | 5/1938 | Bravi |
| 2,118,849 | A | | 5/1938 | Lindsey |
| 2,128,843 | A | | 8/1938 | Mullins |
| 2,140,748 | A | | 12/1938 | Johanson |
| 2,158,971 | A | | 5/1939 | Stratton |
| 2,165,539 | A | | 7/1939 | Dahlgren |
| 2,192,472 | A | | 3/1940 | Huston |
| 2,192,473 | A | | 3/1940 | Huston |
| 2,197,219 | A | | 4/1940 | Gorshong |
| 2,201,956 | A | | 5/1940 | Little |
| 2,208,229 | A | | 7/1940 | Ranney |
| 2,210,194 | A | | 8/1940 | Baldwin |
| 2,210,195 | A | | 8/1940 | Baldwin |
| 2,210,196 | A | | 8/1940 | Baldwin |
| 2,212,773 | A | | 8/1940 | Gray |
| 2,251,102 | A | | 7/1941 | Atterberg |
| 2,263,191 | A | | 11/1941 | Saladin et al. |
| 2,268,379 | A | | 12/1941 | Bird et al. |
| 2,276,577 | A | | 3/1942 | Hahn |
| 2,277,097 | A | | 3/1942 | Hansen |
| 2,289,028 | A | | 7/1942 | Manko |
| 2,316,796 | A | | 4/1943 | Lichter |
| 2,319,560 | A | | 5/1943 | Salfisberg |
| 2,327,301 | A | | 8/1943 | Davis |
| 2,339,656 | A | | 1/1944 | Shina |
| 2,343,222 | A | | 2/1944 | Nelson |
| 2,353,761 | A | | 7/1944 | Ringler |
| 2,379,934 | A | | 7/1945 | Seiferth |
| 2,380,367 | A | | 7/1945 | Ranney |
| 2,463,313 | A | | 3/1949 | Ringler |
| 2,470,388 | A | | 5/1949 | Ball |
| 2,514,255 | A | | 7/1950 | Piazze |
| 2,547,779 | A | | 4/1951 | Renyck |
| 2,578,583 | A | | 12/1951 | O'Brien |
| 2,605,897 | A | | 5/1952 | O'Brien |
| 2,619,092 | A | | 11/1952 | Ayers |
| 2,619,226 | A | | 11/1952 | Adams |
| 2,651,153 | A | | 9/1953 | Burnett |
| 2,682,475 | A | | 6/1954 | Smith |
| 2,719,663 | A | | 10/1955 | Meyer-Jagenberg |
| 2,744,624 | A | | 5/1956 | Hoogstoel et al. |
| 2,755,918 | A | | 7/1956 | Gargagliano |
| 2,799,441 | A | | 7/1957 | Nerney |
| 2,801,002 | A | | 7/1957 | Volckening et al. |
| 2,803,376 | A | | 8/1957 | Kampff |
| 2,812,057 | A | | 11/1957 | Brownfield |
| 2,820,545 | A | | 1/1958 | Bramhill |
| 2,823,798 | A | | 2/1958 | Volckening et al. |
| 2,858,060 | A | | 10/1958 | Kuchler |
| 2,871,080 | A | | 1/1959 | Shelly |
| 2,883,045 | A | | 4/1959 | Abramson |
| 2,923,110 | A | | 2/1960 | Tamarin |
| 2,933,182 | A | | 4/1960 | Davis |
| 2,954,116 | A | | 9/1960 | Maso et al. |
| 2,959,338 | A | | 11/1960 | Thurston |
| 2,962,161 | A | | 11/1960 | Lacy |
| 2,988,209 | A | | 6/1961 | Parrilla |
| 3,002,674 | A | | 10/1961 | Wright |
| 3,027,998 | A | | 4/1962 | Ridgway |
| 3,035,756 | A | | 5/1962 | Mullinix |
| 3,039,671 | A | | 6/1962 | Chiamardas |
| 3,047,144 | A | | 7/1962 | Wissel |
| 3,071,244 | A | | 1/1963 | Doran |
| 3,092,501 | A | | 6/1963 | Beck et al. |
| 3,093,292 | A | | 6/1963 | Ahlbor |
| 3,108,711 | A | | 10/1963 | Anton |
| 3,113,673 | A | | 12/1963 | Stein |
| 3,118,588 | A | | 1/1964 | Noble |
| 3,152,694 | A | | 10/1964 | Nashed et al. |
| 3,165,249 | A | | 1/1965 | Peck |
| 3,187,889 | A | | 6/1965 | Sinclair |
| 3,201,258 | A | | 8/1965 | Mastella |
| 3,204,759 | A | | 9/1965 | Palmer |
| 3,206,094 | A | | 9/1965 | Humphrey et al. |
| 3,272,423 | A | | 9/1966 | Bjarno |
| 3,282,413 | A | | 11/1966 | Sparks |
| 3,322,323 | A | | 5/1967 | Greene et al. |
| 3,323,643 | A | | 6/1967 | Rush |
| 3,367,552 | A | | 2/1968 | Krzyanowski |
| 3,374,884 | A | | 3/1968 | Chinkes |
| 3,389,784 | A | | 6/1968 | Hendricks et al. |
| 3,389,852 | A | | 6/1968 | Egli |
| 3,438,565 | A | | 4/1969 | Lugt et al. |
| 3,472,362 | A | | 10/1969 | Shinoda |
| 3,509,989 | A | | 5/1970 | Woll |
| 3,524,583 | A | | 8/1970 | Gregory |
| 3,542,191 | A | | 11/1970 | Scott |
| 3,580,466 | A | | 5/1971 | Thelan |
| 3,583,358 | A | | 6/1971 | Hanson, Jr. |
| 3,591,071 | A | | 7/1971 | Rosenburg, Jr. |

| | | | |
|---|---|---|---|
| 3,623,653 | A | 11/1971 | Work |
| 3,664,572 | A | 5/1972 | Puchkoff et al. |
| 3,680,766 | A | 8/1972 | Collura et al. |
| 3,708,946 | A | 1/1973 | Cahill |
| 3,710,977 | A | 1/1973 | Van Den Enden et al. |
| 3,732,663 | A | 5/1973 | Geldmacher |
| 3,734,280 | A | 5/1973 | Amneus et al. |
| 3,734,801 | A | 5/1973 | Sebel |
| 3,756,385 | A | 9/1973 | Steinbock |
| 3,835,989 | A | 9/1974 | Mori et al. |
| 3,881,649 | A | 5/1975 | Krautsack |
| 3,923,239 | A | 12/1975 | Lee |
| 3,924,739 | A | 12/1975 | Gravesteijn |
| 3,966,045 | A | 6/1976 | Perdue |
| 3,966,113 | A | 6/1976 | Tipton |
| 4,009,838 | A | 3/1977 | Tashman |
| 4,015,770 | A | 4/1977 | Tamarin |
| 4,053,049 | A | 10/1977 | Beauvais |
| 4,101,024 | A | 7/1978 | Furuya et al. |
| 4,119,196 | A | 10/1978 | Flaherty |
| 4,125,189 | A | 11/1978 | Fujimoto et al. |
| 4,131,195 | A | 12/1978 | Worrell, Sr. |
| D250,748 | S | 1/1979 | Leger |
| 4,142,635 | A | 3/1979 | Capo et al. |
| 4,192,420 | A | 3/1980 | Worrell, Sr. et al. |
| 4,197,949 | A | 4/1980 | Carlsson |
| 4,216,898 | A | 8/1980 | Davies |
| 4,234,084 | A | 11/1980 | Hutten |
| 4,260,061 | A | 4/1981 | Jacobs |
| RE30,616 | E | 5/1981 | Hofer |
| 4,294,353 | A | 10/1981 | Focke et al. |
| 4,360,106 | A | 11/1982 | Irvine et al. |
| 4,377,235 | A | 3/1983 | Carver |
| 4,411,365 | A | 10/1983 | Horikawa et al. |
| 4,436,205 | A | 3/1984 | Horii |
| 4,441,611 | A | 4/1984 | Sommariva |
| 4,464,154 | A | 8/1984 | Ljungcrantz |
| 4,465,208 | A | 8/1984 | Buban et al. |
| 4,470,508 | A | 9/1984 | Yen |
| 4,546,875 | A | 10/1985 | Zweber |
| 4,552,269 | A | 11/1985 | Chang |
| 4,631,900 | A | 12/1986 | Mattei et al. |
| 4,637,544 | A | 1/1987 | Quercetti |
| 4,666,040 | A | 5/1987 | Murata |
| 4,679,693 | A | 7/1987 | Forman |
| 4,738,359 | A | 4/1988 | Phillips, Jr. |
| 4,850,482 | A | 7/1989 | Campbell |
| 4,874,096 | A | 10/1989 | Tessera-Chiesa |
| 4,902,142 | A | 2/1990 | Lammert et al. |
| 4,949,841 | A | 8/1990 | Focke et al. |
| 4,961,496 | A | 10/1990 | Focke et al. |
| 4,997,082 | A | 3/1991 | Durocher |
| 5,029,712 | A | 7/1991 | O'Brien et al. |
| 5,064,698 | A | 11/1991 | Courtright et al. |
| 5,078,509 | A | 1/1992 | Center et al. |
| 5,080,227 | A | 1/1992 | Focke |
| 5,092,465 | A | 3/1992 | Weder et al. |
| 5,096,113 | A | 3/1992 | Focke |
| 5,123,589 | A | 6/1992 | Cote |
| 5,125,211 | A | 6/1992 | O'Brien et al. |
| 5,128,157 | A | 7/1992 | Ruiz |
| 5,150,720 | A | 9/1992 | Focke et al. |
| 5,178,269 | A | 1/1993 | Evers |
| 5,192,386 | A | 3/1993 | Moir et al. |
| 5,195,637 | A | 3/1993 | Weder |
| 5,215,249 | A | 6/1993 | Gorrieri |
| 5,240,109 | A | 8/1993 | Weder et al. |
| 5,248,508 | A | 9/1993 | Reed et al. |
| 5,251,748 | A | 10/1993 | Adams et al. |
| 5,255,784 | A | 10/1993 | Weder et al. |
| 5,270,061 | A | 12/1993 | Reed et al. |
| 5,271,515 | A | 12/1993 | Berkheimer et al. |
| 5,290,616 | A | 3/1994 | Cowan et al. |
| 5,301,804 | A | 4/1994 | Focke et al. |
| 5,307,988 | A | 5/1994 | Focke et al. |
| 5,311,992 | A | 5/1994 | Weder et al. |
| 5,316,211 | A | 5/1994 | Chang |
| 5,344,008 | A | 9/1994 | DeBlasio et al. |
| D351,104 | S | 10/1994 | Kapp |
| 5,353,956 | A | 10/1994 | Wilson |
| 5,358,171 | A | 10/1994 | Focke |
| 5,370,219 | A | 12/1994 | Violett, Jr. |
| 5,376,388 | A | 12/1994 | Meyers |
| 5,376,389 | A | 12/1994 | Reed et al. |
| 5,407,072 | A | 4/1995 | Weder et al. |
| 5,435,439 | A | 7/1995 | Swart |
| 5,462,223 | A | 10/1995 | Focke et al. |
| D365,023 | S | 12/1995 | Abrams et al. |
| 5,489,060 | A | 2/1996 | Godard |
| 5,510,124 | A | 4/1996 | Kopecky et al. |
| 5,511,658 | A | 4/1996 | Focke et al. |
| 5,515,965 | A | 5/1996 | Boldrini et al. |
| 5,522,205 | A | 6/1996 | Weder |
| 5,553,773 | A | 9/1996 | Focke et al. |
| 5,556,026 | A | 9/1996 | Blankitny |
| 5,560,482 | A | 10/1996 | Katagiri et al. |
| 5,575,385 | A | 11/1996 | Zona |
| 5,607,056 | A | 3/1997 | Whiteside |
| 5,620,550 | A | 4/1997 | Andersson et al. |
| 5,632,378 | A | 5/1997 | Provost |
| 5,636,732 | A | 6/1997 | Gilels et al. |
| 5,665,406 | A | 9/1997 | Reed et al. |
| 5,697,502 | A * | 12/1997 | Linz ..... 206/779 |
| 5,732,823 | A | 3/1998 | Weder et al. |
| 5,738,207 | A | 4/1998 | Trimani |
| 5,783,266 | A | 7/1998 | Gehrke |
| 5,797,494 | A | 8/1998 | Balling et al. |
| 5,823,331 | A | 10/1998 | Maservigi et al. |
| 5,836,448 | A | 11/1998 | Weder |
| 5,855,434 | A | 1/1999 | Hagen |
| 5,860,524 | A | 1/1999 | Weder |
| 5,860,526 | A | 1/1999 | Burke, Jr. |
| 5,871,142 | A | 2/1999 | Josephson |
| 5,878,883 | A | 3/1999 | Weder |
| 5,885,630 | A | 3/1999 | Zurawski et al. |
| 5,941,641 | A | 8/1999 | Kinigakis et al. |
| 5,944,188 | A | 8/1999 | Grosskopf et al. |
| 5,992,621 | A | 11/1999 | Grant et al. |
| 6,001,397 | A | 12/1999 | Boyd et al. |
| 6,010,724 | A | 1/2000 | Boyd et al. |
| 6,026,953 | A | 2/2000 | Nakamura et al. |
| D421,568 | S | 3/2000 | Ferguson et al. |
| 6,044,848 | A | 4/2000 | Huang |
| 6,094,917 | A | 8/2000 | Sundhar et al. |
| 6,105,856 | A | 8/2000 | Kakiuchi |
| 6,164,444 | A | 12/2000 | Bray et al. |
| 6,199,687 | B1 | 3/2001 | Tambo et al. |
| 6,202,838 | B1 | 3/2001 | Tran |
| 6,220,430 | B1 | 4/2001 | Boriana et al. |
| 6,228,450 | B1 | 5/2001 | Pedrini |
| 6,237,760 | B1 | 5/2001 | Parker et al. |
| 6,309,105 | B1 | 10/2001 | Palumbo |
| 6,334,532 | B1 | 1/2002 | Tambo et al. |
| 6,395,317 | B1 | 5/2002 | Singh et al. |
| D465,416 | S | 11/2002 | Dzwill et al. |
| 6,478,149 | B1 | 11/2002 | Parker |
| 6,505,735 | B1 | 1/2003 | Parker |
| D471,804 | S | 3/2003 | Staples |
| D479,464 | S | 9/2003 | Kopecky |
| D479,646 | S | 9/2003 | Overton |
| 6,644,488 | B1 | 11/2003 | Coleman |
| D484,046 | S | 12/2003 | Kopecky |
| 6,709,684 | B2 | 3/2004 | Loth |
| D492,814 | S | 7/2004 | Bray et al. |
| 6,941,728 | B1 | 9/2005 | Bray et al. |
| 7,159,717 | B2 | 1/2007 | Aldridge et al. |
| 2002/0063079 | A1 | 5/2002 | Loth |
| 2003/0034255 | A1 | 2/2003 | Luton et al. |
| 2003/0047470 | A1 | 3/2003 | Parker |
| 2003/0080020 | A1 | 5/2003 | Kopecky |
| 2003/0106928 | A1 | 6/2003 | Li Vigni et al. |
| 2003/0127352 | A1 * | 7/2003 | Buschkiel et al. ..... 206/494 |

FOREIGN PATENT DOCUMENTS

| | | |
|---|---|---|
| DE | 653242 | 11/1937 |
| DE | 9405638 | 6/1994 |
| DE | 10238905 A1 | 3/2004 |
| EP | 0 801 000 A2 | 10/1997 |

| | | | |
|---|---|---|---|
| FR | 762011 | | 4/1934 |
| FR | 1204079 | | 1/1960 |
| GB | 2074532 | A | 11/1981 |
| GB | 2078202 | A | 1/1982 |
| GB | 2227221 | A | 7/1990 |
| JP | 61-205930 | U | 12/1986 |
| JP | 62-076121 | U | 5/1987 |
| JP | 2-138584 | | 11/1990 |
| JP | 07-099891 | | 4/1995 |
| JP | 11-1220 | | 1/1999 |
| JP | 11-1221 | | 1/1999 |
| WO | 88/08602 | | 11/1988 |
| WO | 01/07335 | A1 | 2/2001 |
| WO | 03/037744 | A1 | 5/2003 |

* cited by examiner

PACKAGING DESIGN WITH SEPARATE COMPARTMENTS

CROSS-REFERENCE TO RELATED APPLICATIONS

This application is a continuation of U.S. patent application Ser. No. 12/713,359, filed on Feb. 26, 2010, entitled "Packaging Design with Separate Compartments," now U.S. Pat. No. 7,913,846; which is a continuation of U.S. patent application Ser. No. 12/113,341, filed on May 1, 2008, entitled "Packaging Design with Separate Compartments," now U.S. Pat. No. 7,686,165; which is a continuation of U.S. patent application Ser. No. 11/111,523, filed on Apr. 21, 2005, entitled "Packaging Design with Separate Compartments," now U.S. Pat. No. 7,569,008; which is a continuation of U.S. patent application Ser. No. 11/025,739, filed on Dec. 22, 2004, entitled "Packaging Design with Separate Compartments," now U.S. Pat. No. 7,159,717; which claims the benefit of U.S. Provisional Application No. 60/570,004, filed on May 11, 2004, entitled "Gum Slab Packaging with Adhesive Securement"; U.S. Provisional Application No. 60/570,015, filed on May 11, 2004, entitled "Gum Slab Packaging having Adhesive Flap"; and U.S. Provisional Application No. 60/576,122, filed on Jun. 2, 2004, entitled "Packaging Design with Separate Compartments," the contents of which are each incorporated herein by reference.

FIELD

This invention relates generally to packaging for chewing gum and other products, and more particularly to multiple compartment packaging for chewing gum and other products.

BACKGROUND

Chewing gum is currently available to consumers in a variety of different formats. These include stick gum, slab gum, pellet gum, extruded gum, and others. Stick gum may come in sizes with a length of approximately 6-7 cm, a width of approximately 1.5-2 cm, and a thickness of approximately 0.2 cm. Slab gum may come in a size of approximately 4.5 cm in length, 1.2 cm in width, and 0.3 cm in thickness.

A variety of types of gum packaging also exist, including certain types of packaging used predominately for one or the other of the gum formats. Slabs of gum have often been sold in foil packages. Originally, these slabs were arranged in a package in a side-to-side manner, perhaps including five to seven slabs per package. More recently, these slabs have been arranged within the foil packages in a face-to-face manner, allowing 15-20 slabs to be contained in a convenient package.

Such packaging is currently popular and achieves satisfactory results. It has been discovered, however, that this approach does have certain drawbacks. These drawbacks relate to the lack of a suitable means for closing the package once it has been opened. Typically, a portion of the foil packaging is torn off to allow access to the slabs. The package may then be stored or placed in a purse, jacket, or pants pocket. While stored in this manner, some of the slabs may fall out of the package. Also, while stored in this manner it is very possible for foreign material, such as lint, dirt, and so forth, to enter the package. Subsequently, when the package is retrieved from the purse or pocket, some of the slabs may have slipped out of the package and be loose in the purse or pocket. Also, the package may not look appealing once retrieved from the purse or pocket, due to foreign material that may have entered or adhered to the package. This point is important to those who market gum products, as they seek to enhance the social aspects of sharing the contents of the gum package with others.

It is against this background and with a desire to improve on the prior art that a packaging design for gum and other products has been developed.

SUMMARY

A package for containing pieces of an edible product is provided that includes an upper compartment and a lower compartment, each compartment being formed to receive and contain a plurality of individual pieces of an edible product. The upper compartment is at least partially enclosed on five sides thereof, including a back wall, a front wall, a bottom wall, and a pair of lateral side walls. The lower compartment is at least partially enclosed on five sides thereof, including a back wall, a front wall, a bottom wall, and a pair of lateral side walls. A flap connects the upper and lower compartments to each other.

The upper and lower compartments may be separable from each other. The connection of the flap to the upper compartment may be treated to assist in separating the compartments from each other. The upper compartment may be treated by creating a perforated score line.

The package may further include a cover flap connected to the back wall of the upper compartment. The cover flap may be selectably engageable with the back wall of the lower compartment. The back wall of the lower compartment may include a receiving slot defined therein for selectably receiving a portion of the cover flap. The cover flap may be selectably engageable with the front wall of the upper compartment. The front wall of the upper compartment may include a receiving slot defined therein for selectably receiving a portion of the cover flap.

The flap may have a height approximately equal to the sum of one of the pair of side walls of the upper compartment and one of the pair of side walls of the lower compartment. The flap may have a height approximately equal to one of the pair of side walls of the lower compartment. The flap may be connected in a manner to cause the back wall of the lower compartment to be generally aligned with the back wall of the upper compartment when the lower compartment is allowed to hang downward from the upper compartment. The flap may be connected in a manner to cause the back wall of the lower compartment to be generally aligned with the front wall of the upper compartment when the lower compartment is allowed to hang downward from the upper compartment.

The package may be formed from two paperboard blanks, one of which forms the upper compartment and another of which forms the lower compartment. The pieces of an edible product may be individual slabs of chewing gum. The front walls of the upper and lower compartments may be partial walls, to allow access to the individual pieces of an edible product that may be contained in the compartments.

Another aspect of the package for containing pieces of an edible product includes a first paperboard blank folded to define a compartment having a back wall, a front wall, a bottom wall, and a pair of lateral side walls and a second paperboard blank folded to define a compartment having a back wall, a front wall, a bottom wall, and a pair of lateral side walls. The second paperboard blank also include an upper flap that is attached to the first paperboard blank so that the compartment formed by the first paperboard blank is an upper compartment and the compartment formed by the second paperboard blank is a lower compartment, each of the upper and lower compartments being suitably shaped and sized to receive and contain a plurality of pieces of an edible product.

The upper and lower compartments may be connected together by a flap, the flap having a height approximately equal to the sum of one of the pair of side walls of the upper compartment and one of the pair of side walls of the lower compartment. The upper and lower compartments may be connected together by a flap, the flap having a height approximately equal to one of the pair of side walls of the lower compartment.

Another aspect of the method of forming a package for containing pieces of an edible product includes providing a first and a second paperboard blank and folding the first paperboard blank to form a cover flap and a compartment having a back wall, a front wall, a bottom wall, and a pair of lateral side walls, the compartment being suitably shaped and sized to receive and contain a plurality of pieces of an edible product. The method also includes folding the second paperboard blank to form a connecting flap and a compartment having a back wall, a front wall, a bottom wall, and a pair of lateral side walls, the compartment being suitably shaped and sized to receive and contain a plurality of pieces of an edible product, and attaching the connecting flap of the second paperboard blank to the first paperboard blank.

The method may further include pivoting the compartment formed of the first paperboard blank relative to the connecting flap and pivoting the compartment formed of the second paperboard blank relative to the connecting flap to bring the front walls of each compartment adjacent to each other. The method may further include folding the cover flap over at least a portion of the compartment formed of the second paperboard blank. The method may further include selectably engaging a portion of the cover flap with the compartment formed of the second paperboard blank. The compartment formed of the second paperboard blank may include a slot formed in the back wall thereof to receive a portion of the cover flap.

The method may further include separating a substantial majority of the second paperboard blank from the first paperboard blank at a subsequent time. The method may further include folding the cover flap over at least a portion of the compartment formed of the first paperboard blank. The method may further include selectably engaging a portion of the cover flap with the compartment formed of the first paperboard blank. The compartment formed of the first paperboard blank may include a slot formed in the front wall thereof to receive a portion of the cover flap.

Another aspect of the package for containing pieces of an edible product includes a first paperboard blank folded to define an upper compartment to receive and contain a plurality of pieces of an edible product, the upper compartment being at least partially enclosed on five sides thereof, and including a back wall, a front wall, a bottom wall, and a pair of lateral side walls. The package also includes a second paperboard blank folded to define a lower compartment to receive and contain a plurality of pieces of an edible product, the lower compartment being at least partially enclosed on five sides thereof, and including a back wall, a front wall, a bottom wall, and a pair of lateral side walls, wherein the second paperboard blank also includes an upper flap that is attached to the first paperboard blank. The package further includes a cover flap connected to the back wall of the upper compartment, wherein the cover flap is selectably engageable with a receiving slot defined in the back wall of the lower compartment.

Another aspect of the package for containing pieces of an edible product includes a first compartment and a second compartment, each compartment being formed to receive and contain a plurality of pieces of a product. The first compartment is at least partially enclosed on five sides thereof, including a back wall, a front wall, a bottom wall, and a pair of lateral side walls. The second compartment is at least partially enclosed on five sides thereof, including a back wall, a front wall, a bottom wall, and a pair of lateral side walls. The first and second compartment are connected to each other by a flap.

Another aspect of the package for containing pieces of an edible product includes a first paperboard blank folded to define a compartment having a back wall, a front wall, a bottom wall, and a pair of lateral side walls, and a second paperboard blank folded to define a compartment having a back wall, a front wall, a bottom wall, and a pair of lateral side walls. The second paperboard blank also includes an upper flap that is attached to the first paperboard blank so that the compartment formed by the first paperboard blank is an upper compartment and the compartment formed by the second paperboard blank is a lower compartment, each of the upper and lower compartments being suitably shaped and sized to receive and contain pieces of a product.

Numerous additional features and advantages of the present invention will become apparent to those skilled in the art upon consideration of the further description that follows.

DETAILED DESCRIPTION

Reference will now be made to the accompanying drawings, which assist in illustrating the various pertinent features of the packaging design. Although the invention will now be described primarily in conjunction with gum packaging, it should be expressly understood that the invention may be applicable to other applications where multiple separable compartments, each for one or more removable objects, is required/desired. In this regard, the following description of a gum packaging design is presented for purposes of illustration and description. Furthermore, the description is not intended to limit the invention to the form disclosed herein. Consequently, variations and modifications commensurate with the following teachings, and skill and knowledge of the relevant art, are within the scope of the packaging design. The embodiments described herein are further intended to explain modes known of practicing the invention and to enable others skilled in the art to utilize the invention in such, or other embodiments and with various modifications required by the particular application(s) or use(s) of the packaging design.

Figure 1:
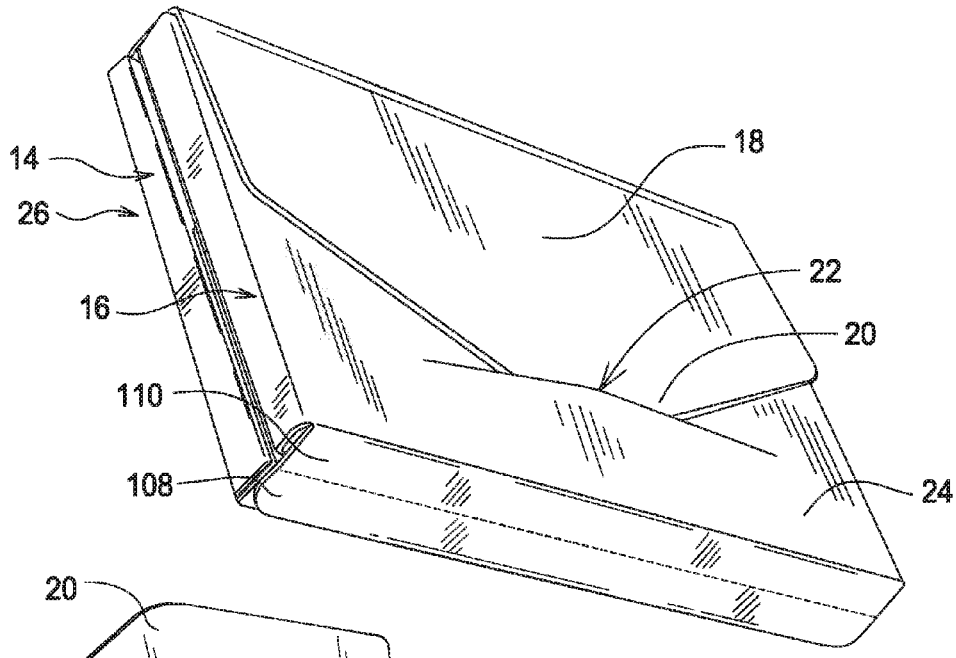
FIG. 1 is a perspective view of the packaging design, shown in a closed position.
Figure 7:
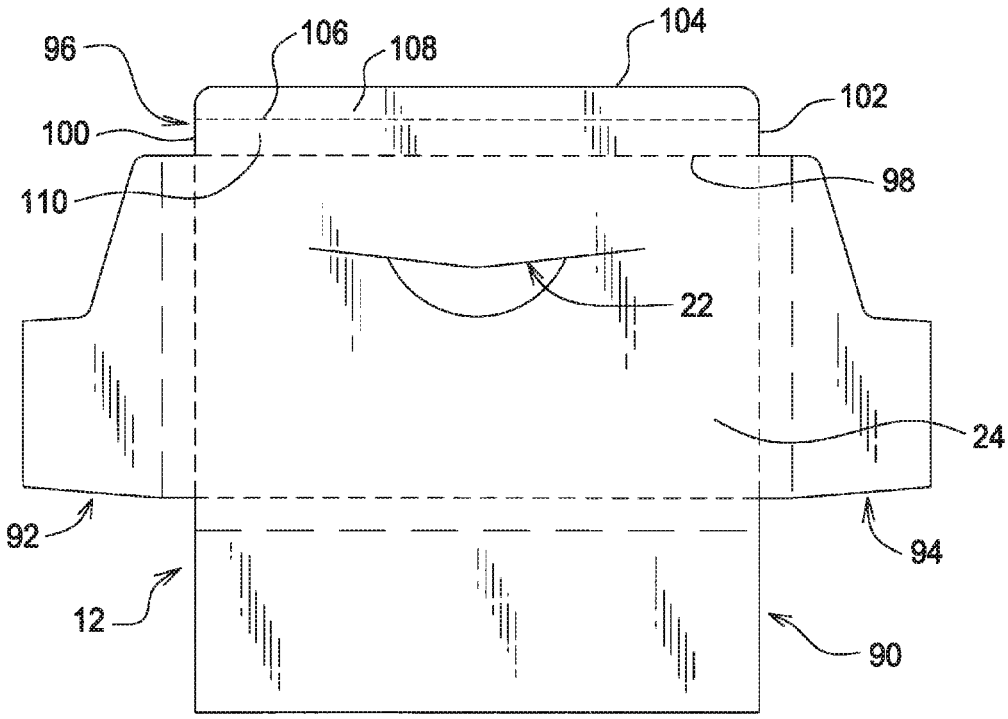
FIG. 7 is a plan view of a second unfolded paperboard blank used to form the lower compartment of the packaging design.

The packaging design employs two paperboard blanks 10 and 12 (FIGS. 5 and 7), scored in a manner to be folded so that each form a compartment for containing a consumable product, such as chewing gum. One of the blanks forms an upper compartment 14, while the other of the blanks forms a lower compartment 16. One blank (or compartment) is adhered to the other in a manner to allow one to be easily separated from the other by tearing along a perforation. The compartments 14 and 16 are originally provided in this attached manner and folded together to place one facing the other, with a cover flap 18 from the upper compartment 14 having an end 20 laid over a receiving slot 22 in a back panel 24 of the lower compartment 16. The consumer can tuck this end 20 into the slot 22 to form a compact package 26, such as is shown in FIG. 1.

Figure 2:
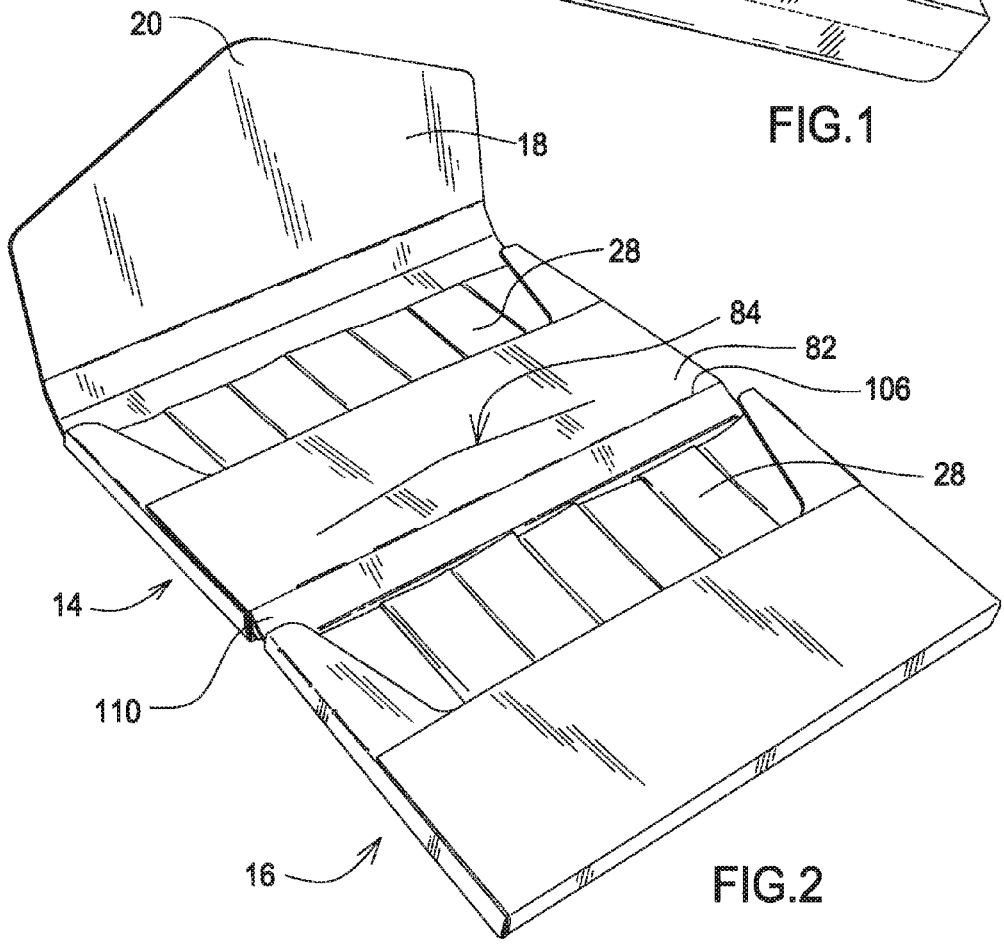
FIG. 2 is a perspective view of the packaging design of FIG. 1, shown in an open position and containing a plurality of individually packaged slabs of gum.
Figure 3:
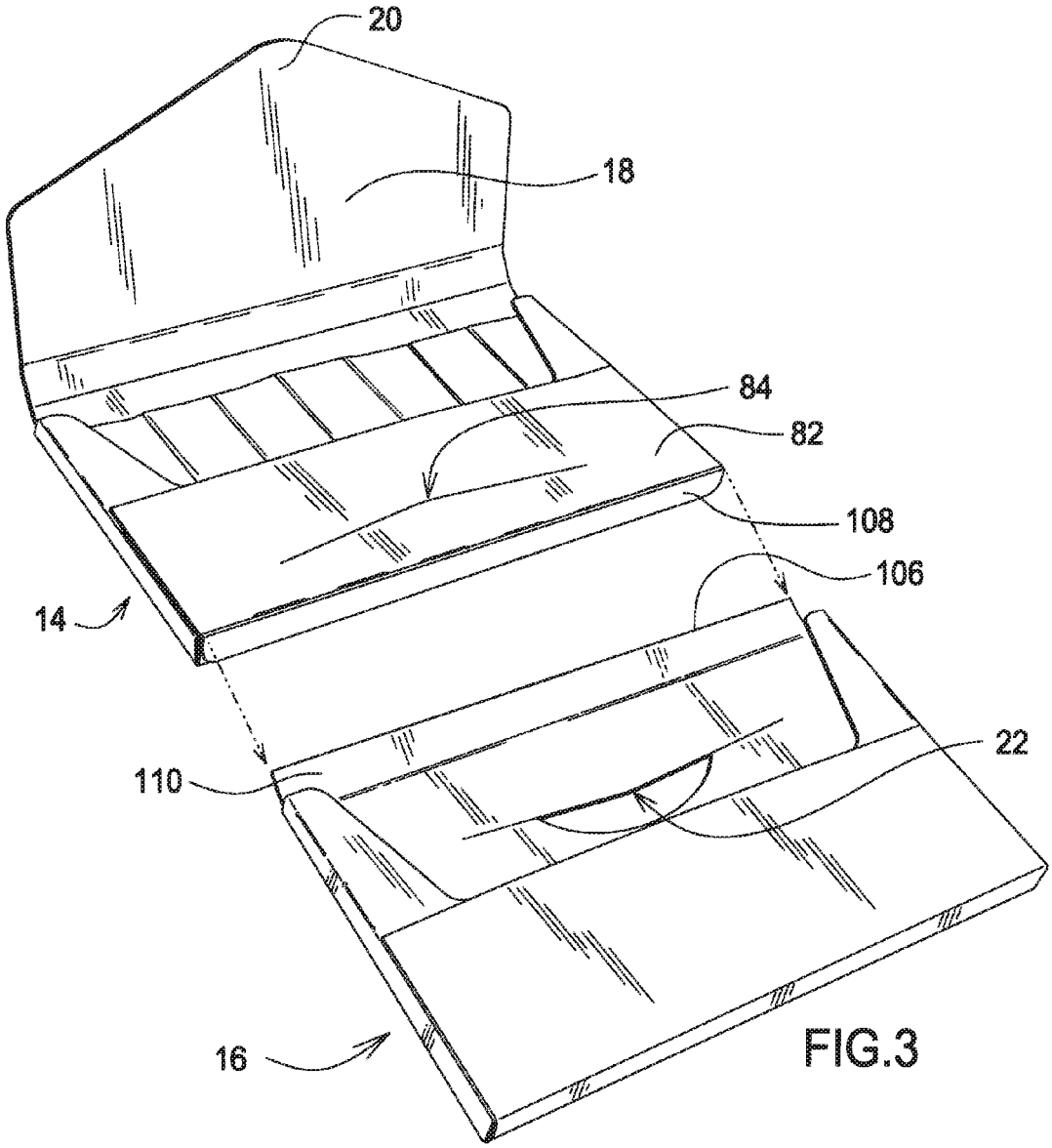
FIG. 3 is a perspective view of the packaging design of FIG. 1, after an empty lower compartment thereof has been separated therefrom.
Figure 4:
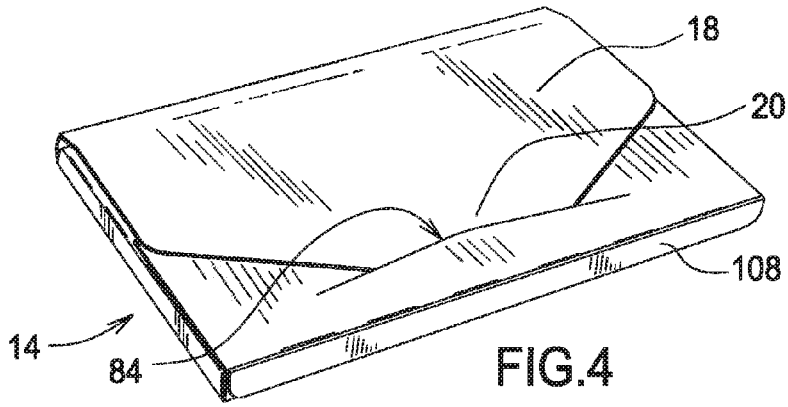
FIG. 4 is a perspective view of the remaining portion of the packaging design of FIG. 3, showing a cover flap thereof tucked in place to close the package, after the empty lower compartment has been removed.

Once purchased, a clear film (not shown) can be removed from the package 18 so that the customer can lift the flap 18 to allow the lower compartment 16 to swing down into the position shown in FIG. 2. In this position, the customer can remove slabs 28 of the product as desired or share with others. The package 26 can then be returned to its original configuration as shown in FIG. 1. If the customer wishes, they can consume the slabs 28 of gum from the lower compartment 16 first and then, once emptied, separate the compartments 14 and 16 from each other by tearing along a perforated score line as shown in FIG. 3. Next, if desired, the customer can fold the cover flap 18 down over the upper compartment 14 and tuck the end 20 of the cover flap 18 into a receiving slot 84 formed in the upper compartment 14 (as shown in FIG. 4) and continue to use the upper compartment 14 of the package 26 in this manner until all the product is consumed.

Figure 5:
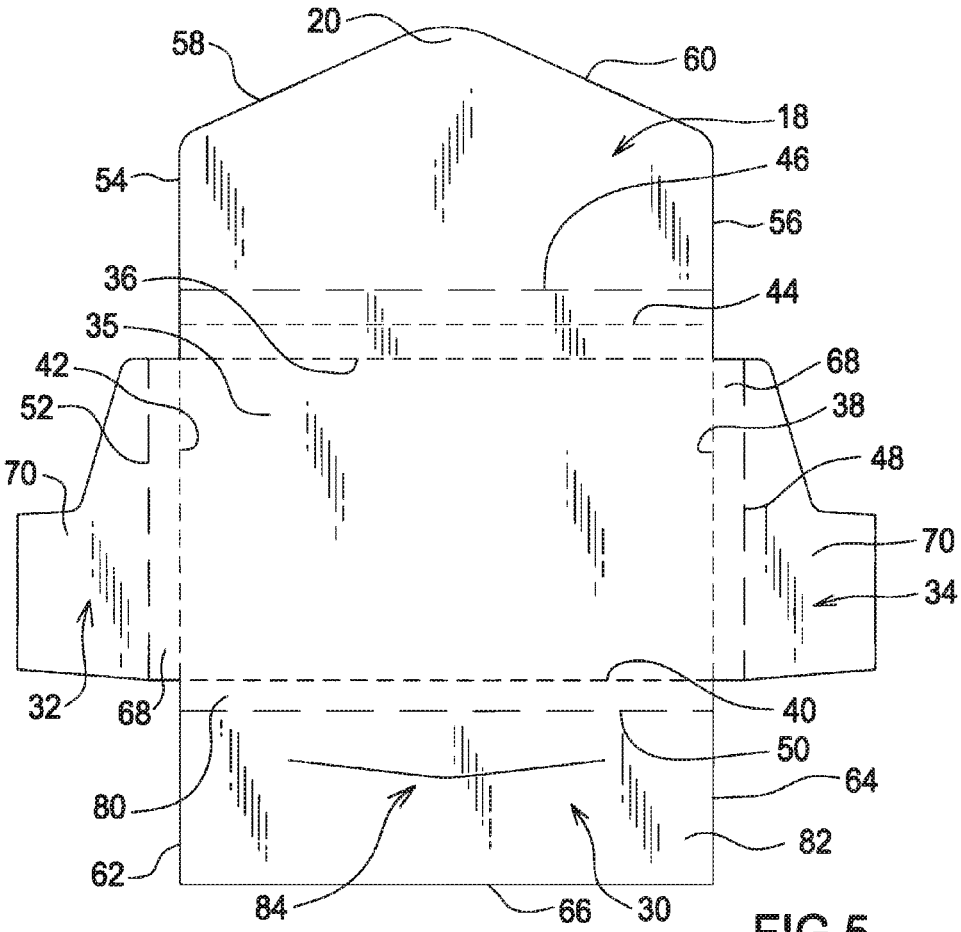
FIG. 5 is a plan view of a first unfolded paperboard blank used to form the upper compartment and cover flap of the packaging design.

As shown in FIG. 5, the first paperboard blank 10 has the cover flap 18 extending from one side thereof and a bottom flap 30 extending from an opposite side thereof. On the lateral sides of the first paperboard blank 10, a pair of lateral side flaps 32 and 34 extend in opposite directions. The remaining central portion of the first paperboard blank 10 forms a back panel 35 for the upper compartment 14. The first paperboard blank 10 is composed of SBS (solid bleach sulfate) paperboard, in part because of the good folding properties of this material. Alternatively, the compartments 14 and 16 could be composed of some other suitable material, such as polyvinyl chloride (PVC). The paperboard material may have a white clay emulsion coating on an outside surface thereof and no coating on an inside surface thereof. The coating enhances the ability to print on the paperboard, which may occur prior to the cut, scoring, and assembly steps described below. There could also be a laminate of holographic material added to the printed side.

As can be seen in FIG. 5, the cover flap 18 is generally five-sided with one side being defined along the score line 36, two orthogonal lateral sides 54 and 56 and a pair of top sides 58 and 60 that extend from the lateral sides 54 and 56 and meet at the end 20 of the cover flap 18. The bottom flap 30 includes a side that is defined by the score line 40, a pair of orthogonal lateral sides 62 and 64 and a bottom side 66 that is orthogonal to the lateral sides 62 and 64. The lateral side flaps 32 and 34 are mirror images of each other, so only lateral side flap 32 will be described in detail. The lateral side flap 32 includes a generally rectangular portion between the score lines 42 and 52 that will form a side panel 68 to the upper compartment 14. The remaining portion of the lateral side flap 32 forms a front wing 70 after the lateral side flap 32 is folded along score lines 42 and 52. The front wing includes a generally rectangular section and a generally triangular section located above the generally rectangular section.

As can be appreciated in FIG. 5, the first paperboard blank 10 is scored in multiple places along score lines 36, 38, 40, 42, 44, 46, 48, 50, and 52. Lines 36, 38, 40, 42, and 44 are regular score lines, while lines 46, 48, 50, and 52 are cut score lines. A regular score line is a crease formed in the paperboard using a tool having male and female matching channels that are applied to the paperboard blank 10 from opposite sides to form a V shape in the material. A cut score line differs from a regular score line in that the cut score line is not only scored in the manner described above, but small slits are also cut entirely through the material at spaced apart locations along the line. A cut score creates a line that is easier to fold than does a regular score line. The drawback is that a cut score line does not have as neat an appearance as a regular score line when the assembled closed is viewed externally by a consumer. For this reason, lines that will be visible when the package is fully assembled, as shown in FIG. 1, are regular score lines while the remaining fold lines may be cut score lines.

Figure 6:
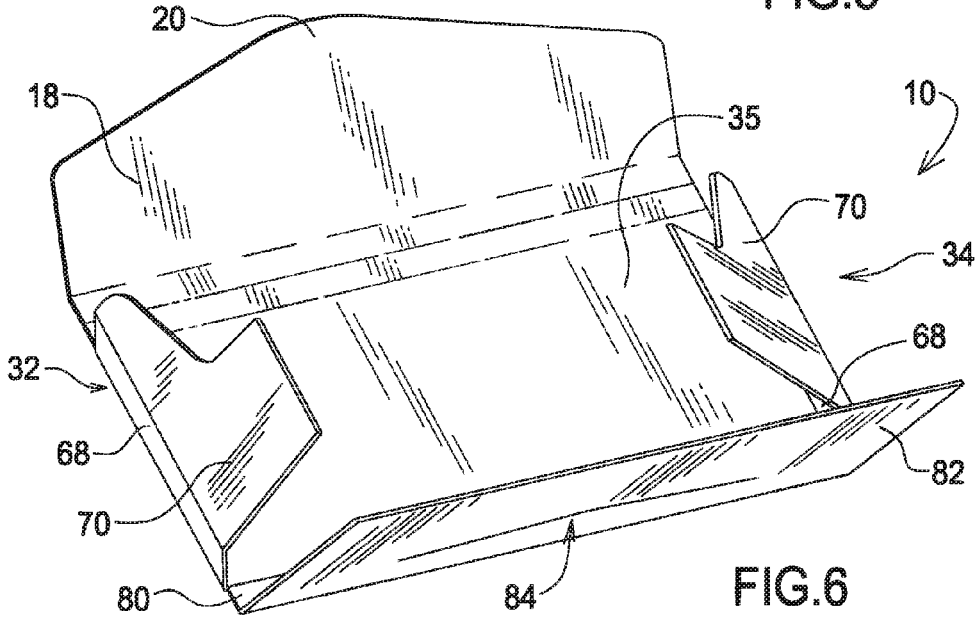
FIG. 6 is a perspective view of the blank of FIG. 5, showing the side flaps folded up, and the bottom flap partially folded.

As is illustrated in FIGS. 5 and 6, the lateral side flaps 32 and 34 are folded along score lines 42, 52, 38, and 48 to form the front wings 70, while the bottom flap 30 is folded along score lines 40 and 50 to form a bottom wall 80 and a front panel 82. Adhesive (not shown) can then be applied to the surface of the front wings facing toward the front panel and/or to the portion of the front panel facing toward the front wings to affix the front panel 82 to the front wings 70. In this manner, the upper compartment 14 is formed from the first paperboard blank 10.

The bottom flap 30 includes a receiving slot 84 formed in the front panel 82 thereof. In FIG. 4, the upper compartment 14 is shown with the end 20 of the cover flap 18 inserted into the receiving slot 84 on the front panel 82 of the upper compartment 14. As can be appreciated, it is intended that this slot 84 would only be used to close the package when the lower compartment 16 has been removed.

The second paperboard blank 12 is similar to the first paperboard blank in many respects. It is composed of the same material and has a clay coating on one side to enhance the ability to print material thereon. The second paperboard blank 12 also includes a bottom flap 90 and lateral side flaps 92 and 94 that are identical to the bottom flap 30 and lateral side flaps 32 and 34 of the first paperboard blank 10. The primary differences between the second paperboard blank 12 and the paperboard blank 10 relate to a connecting flap 96 on the second paperboard blank 12 and the receiving slot 22 on the lower compartment 16.

Figure 8:
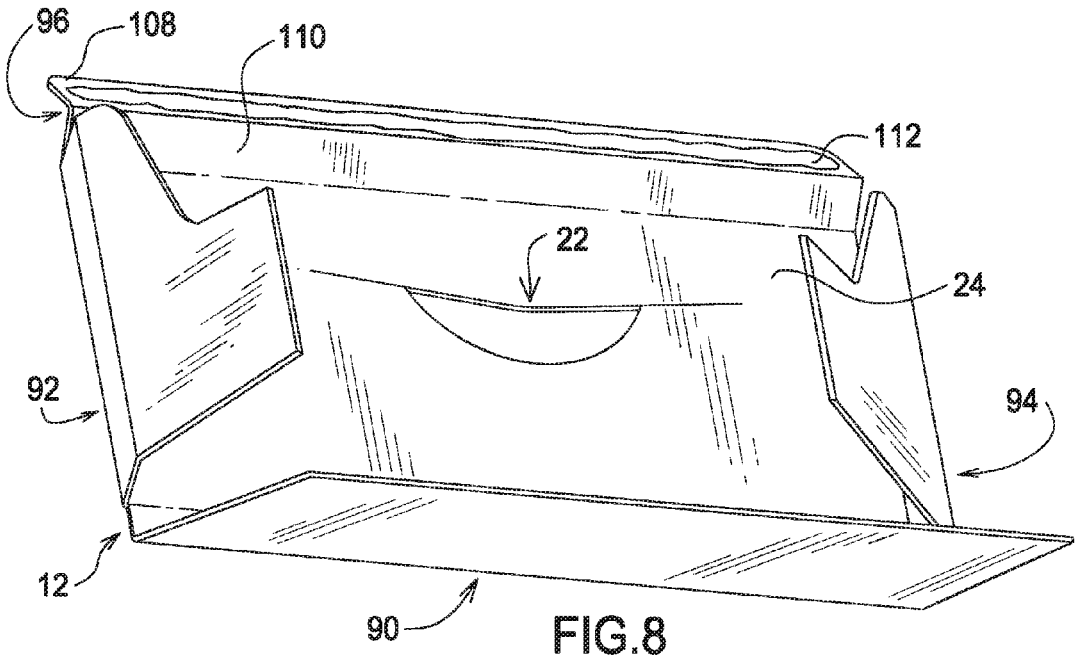
FIG. 8 is a perspective view of the blank of FIG. 7, showing the side flaps folded up, the bottom flap partially folded up, and the connecting flap folded down, with adhesive applied thereto.

The connecting flap 96 of the second paperboard blank 12 is significantly different than the cover flap 18 of the first paperboard blank 10. The connecting flap 96 is generally rectangular with one side being defined by a regular score line 98 on a bottom side thereof, a pair of lateral sides 100 and 102, and a top side 104. A perforated score line 106 divides the connecting flap 96 into an upper portion 108 and a lower portion 110. The perforated score line 106 includes a score and a series of perforations that are close enough together to only leave that amount of paper necessary to hold the portions 108 and 110 together until separation is desired. When desired, this perforated score line 106 enables detachment so that portions 108 and 110 can be fairly easily separated by the customer. As is shown in FIGS. 2 and 8, the upper portion 108 of the connecting flap 96 includes adhesive 112 applied to an inner surface thereof for attachment to the outer surface of the bottom wall 80 of the upper compartment 14. This is shown in FIGS. 1 and 2. FIG. 3 shows the two compartments 14 and 16 after they have been separated from each other along the perforated score line 106.

When attached in this manner, the back panel of the lower compartment 16 and the front panel of the upper compartment 14 would tend to hang in generally the same plane when in the open position of FIG. 2 and with the upper compartment held vertically, allowing the lower compartment to hang downwardly therefrom. The lower portion 110 of the connecting flap could then be sized to have a height approximately equal to a side wall of the lower compartment.

The lower compartment 16 also differs from the upper compartment 14 in the location and orientation of the receiving slot 22 on the lower compartment 16 relative to the receiving slot 84 on the upper compartment 14. The receiving slot 22 in the lower compartment 16 is formed in the back panel 24 of the lower compartment 16 as compared to the front panel 82 for the receiving slot 84. In this case, the receiving slot 22 is oriented so that the curved portion points in an opposite direction from the curved portion of the receiving slot 84 when the package is in the orientation shown in FIGS. 2 and 3. When the lower compartment 16 is folded up adjacent to the upper compartment 14 in the orientation shown in FIG. 1, then the curved portion is oriented in a direction to allow the end 20 of the cover flap 18 to be engaged therewith. Other than the differences already described with regard to the connecting flap 96, the folding and attachment of the lateral side flaps 92 and 94 and the bottom flap 90 to each other is performed in a similar manner to that described above in conjunction with the upper compartment 14.

Figure 9:
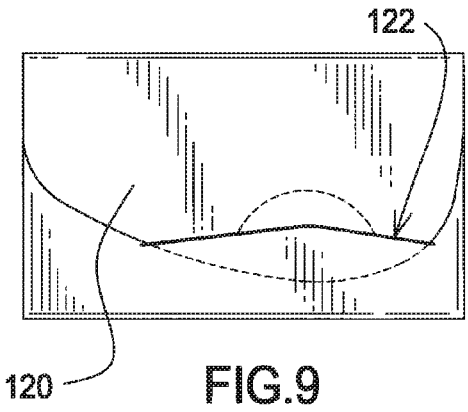
FIG. 9 is a plan view of a second embodiment of the packaging design, showing an alternative shape for the cover flap and receiving slot, the cover flap being tucked into the receiving slot.
Figure 10:
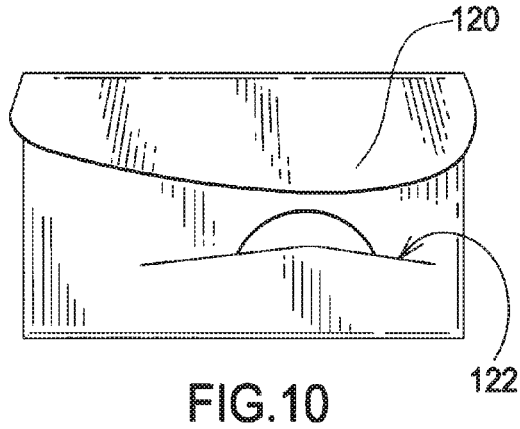
FIG. 10 is a plan view of the second embodiment shown in FIG. 9, the cover flap being untucked from the receiving slot and partially folded upward.
Figure 11:
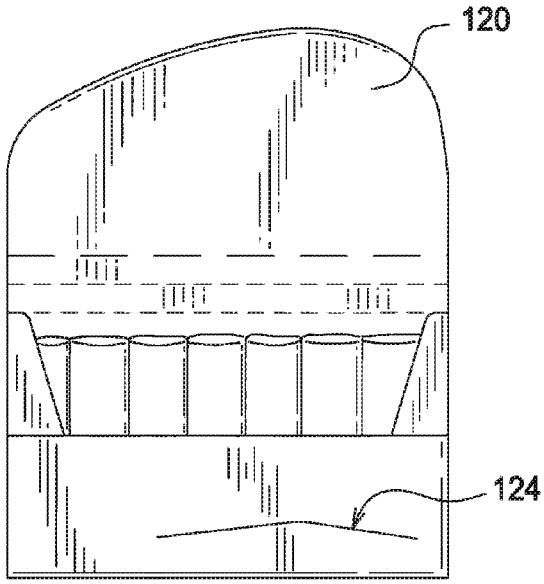
FIG. 11 is a plan view of the second embodiment shown in FIG. 9, the cover flap being untucked from the receiving slot and folded upward and with a lower compartment removed.
Figure 12:
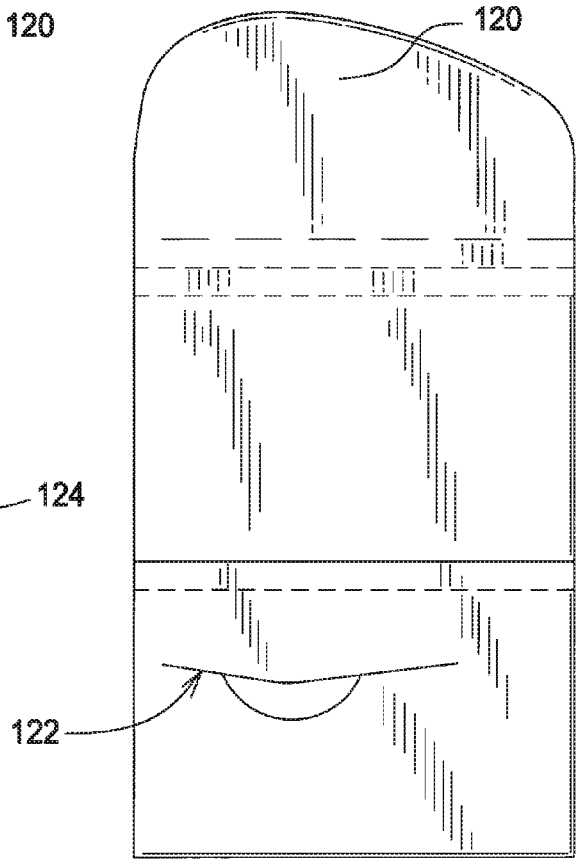
FIG. 12 is a plan view of an opposite side of the second embodiment shown in FIG. 9, the cover flap being untucked from the receiving slot and folded upward and the lower compartment allowed to swing down and hang from the lower compartment.

An alternative embodiment is shown in FIGS. 9 and 10. The primary differences between this embodiment and the first embodiment described above relate to the shape of the cover flap and the location of the receiving slots on the upper and lower compartments. As can be seen, the cover flap 120 in this embodiment is laterally asymmetrical. Consequently, the receiving slot 122 in the lower compartment is offset toward one lateral side so as to be in position to receive an end of the cover flap 120. The receiving slot 124 in the upper compartment is similarly offset in this manner. As can be appreciated, the teachings of this invention apply to other arrangements with differently-shaped cover flaps and differently-shaped and positioned receiving slots.

As another alternative (not shown), the lower compartment 16 could be attached to the upper compartment by applying adhesive 112 to the outer surface of the upper portion 108 of the connecting flap 96 for attachment to the outer surface of the bottom wall 80 of the upper compartment 14. When attached in this manner, the back panels of each of the upper and lower compartments 14 and 16 would tend to hang in generally the same plane when in the open position of FIG. 2 and with the upper compartment held vertically, allowing the lower compartment to hang downwardly therefrom. The lower portion 110 of the connecting flap could then be sized to have a height approximately equal to the sum of a side wall of the upper compartment and a side wall of the lower compartment.

Typically, the gum product is manufactured, then chilled and aged. Slab and stick gum is prepared by rolling the gum product into sheets, cutting it into lanes, then scoring it into individual pieces. It has been found to be useful for the individual slabs of gum to be individually wrapped in separate sheets of waxed paper and then a row of such gum slabs wrapped in such manner can be placed in a foil half-pouch (not shown). The gum package is assembled at the same time. Thus, the paperboard is printed, cut, and scored. It is then folded, filled, assembled, closed, and a clear film with tear tape is attached to the outside. A display tray with twelve such packages is prepared, these display trays are over-wrapped with clear film, and then they are placed in corrugated shippers, palletized, and then shrink-wrapped. It is then warehoused and shipped to distribution centers.

In some embodiments, the gum slabs may be adhered or otherwise attached to the package. This may keep the gum slabs from falling out or tipping over inside of the package. Thus, the gum slabs may be releaseably secured or attached to or into the package. There are many possibilities for adhering the gum slabs into the package. One possibility would be to place the gum slabs into or onto a foil half pouch, paper or plastic strip, wrap around band, or other type of sheet-like material (collectively referred to herein referred to as a "sheet") before it is placed into the package. The sheet may include a single layer or multiple layers. One of the layers may include moisture barrier material to reduce the amount of moisture absorbed by the gum slabs when the gum slabs are in the package.

As an alternative to using a sheet, the gum slabs could be placed directly into the package without the use of a sheet. If the slabs were placed directly into the package, they (or their wrappers) could be adhered thereto or not. For example, the gum slabs may be adhered via wax or other adhesive to one or more inner surfaces of the package. The wax or adhesive may be included or provided in one or more strips or bands of adhesive that adhere to more than one gum slab. The package itself may contain a paraffin or other waxy material on its inner surface to adhere to the gum slabs. Alternatively, a plurality of wax or adhesive spots or areas may be created on one or more inner surfaces of the package, each attaching to one or more of the gum slabs or wrappers around the gum slabs. If wrappers around the gum slabs are used, the adhesive used to adhere the gum slabs to the package will adhere the wrappers to the package. The adhesive bond may be strong enough to prevent or reduce the likelihood of the wrappers being removable from the package. Thus, the wrappers will remain in the package when the gum slabs are removed from the package and the wrappers. Alternatively, the adhesive bond between the wrappers and the package may be such that the wrapper and the gum slabs can be removed from the package, but strong enough to keep the gum slabs in the wrappers from falling out of the package or tipping over in the package. One potential embodiment is illustrated in U.S. Provisional Patent Application No. 60/570,015 entitled "Gum Slab Packaging Having Adhesive Flap" filed May 11, 2004, the contents of which are incorporated by reference herein for all purposes.

As another alternative, the gum slabs may be adhered to each other, regardless of whether or not a sheet is used in the package. For example, drops or a strip of adhesive may be placed on the gum slabs or their wrappers such that the gum slabs or their wrappers are held together. The drops or strip of adhesive may be placed on one or more sides of the gum slabs, which may be placed in a side-by-side configuration in the package. The same or different adhesive also may be used to adhere the gum slabs to the housing and/or to a sheet.

If there is a sheet, it is possible to adhere the gum slabs to the sheet with some type of cold or hot adhesive and then an outer part of the sheet may be adhered to the inner surface or wall of the package. One or more adhesive strips, sports, or other areas may be used to adhere the sheet to one or more inner surfaces of the package. Alternatively, the sheet need not be adhered to the package and simply can be placed inside the package. It may also be desirable to not adhere the slabs to the sheet and then to adhere the sheet to the package. Alternatively, the sheet need not be adhered to the package.

One possibility would include adhering both the sheet and the gum slabs to the one or more inner surfaces or walls of the package. For example, a sheet or pouch could be used that covers only a portion of the gum slabs when the gum slabs are placed on or in the sheet, so that the top portions of the slabs (or their wrappers) extend up above the edge of the sheet when the sheet and the gum slabs are placed inside the package. A strip of adhesive could be applied to the inner back wall of the gum compartment of the package in a position approximately even with or overlapping the upper edge of the pouch. If the adhesive strip was sufficiently large it could allow both the pouch and the top portions of the gum slabs to stick to the inner surface of the package. Alternatively, two different strips of adhesive could be used, one to adhere the slabs (or their wrappers) to the package, and one to adhere the sheet to one or more inner walls or surfaces of the package. These two strips of adhesive could be located on the same inner back wall of the package, or, for example, one could be on the inner back wall of the package to adhere the top portions of the gum slabs to the inner back wall of the package and one on the inner front wall of the package to adhere the sheet to the inner front wall of the package. One potential embodiment is illustrated in U.S. Provisional Patent Application No. 60/570,004 entitled "Gum Slab Packaging with Adhesive Securement" filed May 11, 2004, the contents of which are incorporated by reference herein for all purposes.

It can be appreciated that there are several possible variations on this general theme. In addition, the adhesive need not be applied in strips but could be in another shape or arrangement. Hot wax is one example of a type of adhesive.

As a further example, adhesive may be used to adhere the gum slabs to a sheet and/or to adhere the sheet to one or more inner surfaces or walls of the package. Such a configuration for a different package design is illustrated in U.S. Patent Publication No. 2003/0080020 (U.S. patent application Ser. No. 10/003,336) entitled "Package Having Releaseably Secured Consumable Products", which is herein incorporated by reference for all purposes.

Although the above-described packaging design has been described in conjunction with slab gum, it could also be adapted to work for stick gum, extruded gum, pellet gum, and candy-coated gum. In addition, each compartment could hold as few as one large piece of gum. Furthermore, the packaging design described herein could be used to hold other types of individual pieces of consumable products (e.g., cookies, chocolate bars, taffy, toffee, fruit roll-ups, and so forth). Alternatively, it could be used to sell, mail, distribute, or hold non-edible products such as photos, coupons, tickets, stamps, puzzle pieces, game pieces, and so forth. The individual items in the package may all be the same or they may be different items that can be assembled together, or in the case of edible products they may be different types or flavors. The package could also be used to hold pharmaceuticals or nutraceuticals such as pills, vitamins, oral care strips, and so forth or items that may not be chewed or swallowed (e.g., chewing tobacco, pain relieving strips for gum diseases, and so forth).

As can be appreciated, there are many advantages to the package design. One advantage relates to having a single row of gum slabs as compared to two or more rows of gum slabs adjacent to each other. In this case, it is easier to extract a single piece at a time, and the remaining pieces are less likely to fall out of the packages. Furthermore, the package has a more pleasing and presentable appearance that may be conducive to sharing the gum products with others. Further, the package securely closes and completely encloses the gum products. Not all of these advantages are necessarily found in each of the embodiments.

The foregoing description of the packaging design has been presented for purposes of illustration and description. Furthermore, the description is not intended to limit the invention to the form disclosed herein. Consequently, variations and modifications commensurate with the above teachings, and skill and knowledge of the relevant art, are within the scope of the invention. The embodiments described hereinabove are further intended to explain best modes known of practicing the invention and to enable others skilled in the art to utilize the invention in such, or other embodiments and with various modifications required by the particular application(s) or use(s) of the invention. It is intended that the appended claims be construed to include alternative embodiments to the extent permitted by the prior art.

What is claimed is:

1. A package for containing pieces of an edible product, comprising:

a first compartment and a second compartment, each compartment being formed to receive and contain a plurality of individual pieces of an edible product;

a connecting flap interconnected to the first and second compartments such that the first and second compartments are pivotable relative to each other along a portion of the connecting flap;

a cover flap, wherein the cover flap is laterally asymmetrical, wherein the first compartment comprises a bottom wall, a front wall, a back wall, and an opening disposed oppositely from the bottom wall of the first compartment, wherein the second compartment comprises a bottom wall, a front wall, a back wall, and an opening disposed oppositely from the bottom wall of the second compartment, wherein the back wall of the first compartment and the cover flap are connected to each other along a fold line common to both the back wall of the first compartment and the cover flap, wherein in a closed state of the package the front wall of the first compartment is flush against the front wall of the second compartment, wherein in an open state of the package the opening of the first compartment is oriented in the same direction as the opening of the second compartment, wherein in the open state of the package the second compartment is pivoted 180 degrees from its position in the closed state, wherein in the closed state of the package the cover flap is selectably positionable such that at least a portion of the cover flap is flush with the back wall of the second compartment; and a receiving slot in the back wall of the second compartment, wherein the receiving slot is offset towards one side so as to be in position to receive an end of the cover flap, wherein the front wall of the first compartment includes a first portion that is a single continuous panel of a single layer of paperboard that extends along an entirety of the width of the first compartment, wherein the first portion of the front wall of the first compartment and the bottom wall of the first compartment are connected to each other along a fold line common to both the first portion of the front wall of the first compartment and the bottom wall of the first compartment, wherein the fold line common to both the first portion of the front wall of the first compartment and the bottom wall of the first compartment extends along an entirety of the width of the first compartment.

2. The package of claim 1, wherein the first portion of the front wall of the first compartment is adhesively bonded to a second portion of the front wall of the first compartment.

3. The package of claim 1, wherein the back wall of the first compartment and the bottom wall of the first compartment are connected to each other along a fold line common to both the back wall of the first compartment and the bottom wall of the first compartment, wherein the back wall of the first compartment extends from the fold line in common with the cover flap to the fold line in common with the bottom wall of the first compartment, and wherein the back wall of the first compartment is a single continuous panel of a single layer of paperboard.

4. A package for containing pieces of an edible product, comprising:

a first compartment and a second compartment, each compartment being formed to receive and contain a plurality of individual pieces of an edible product;

a connecting flap interconnected to the first and second compartments such that the first and second compartments are pivotable relative to each other along a portion of the connecting flap;

a cover flap, wherein the cover flap is laterally asymmetrical, wherein the first compartment comprises a bottom wall, a front wall, a back wall, and an opening disposed oppositely from the bottom wall of the first compartment, wherein the second compartment comprises a bottom wall, a front wall, a back wall, and an opening disposed oppositely from the bottom wall of the second compartment, wherein the back wall of the first compartment and the cover flap are connected to each other along a fold line common to both the back wall of the first compartment and the cover flap, wherein in a closed state of the package the front wall of the first compartment is flush against the front wall of the second compartment, wherein in an open state of the package the opening of the first compartment is oriented in the same direction as the opening of the second compartment, wherein in the closed state of the package the cover flap is selectably positionable such that at least a portion of the cover flap is flush with the back wall of the second compartment, wherein the back wall of the first compartment and the bottom wall of the first compartment are connected to each other along a fold line common to both the back wall of the first compartment and the bottom wall of the first compartment, wherein the back wall of the first compartment extends from the fold line in common with the cover flap to the fold line in common with the bottom wall of the first compartment, wherein the back wall of the first compartment is a single continuous panel of a single layer of paperboard, wherein in the closed state of the package the cover flap is selectably positionable such that a first portion of the cover flap is flush with an outer surface of the back wall of the second compartment and a second portion of the cover flap is simultaneously flush with an inner surface of the back wall of the second compartment, wherein the front wall of the first compartment includes a first portion that is a single continuous panel of a single layer of paperboard that extends along an entirety of the width of the first compartment, wherein the first portion of the front wall of the first compartment and the bottom wall of the first compartment are connected to each other along a fold line common to both the first portion of the front wall of the first compartment and the bottom wall of the first compartment, wherein the fold line common to both the first portion of the front wall of the first compartment and the bottom wall of the first compartment extends along an entirety of the width of the first compartment.

5. A package for containing pieces of an edible product, comprising:

a first compartment and a second compartment, each compartment being formed to receive and contain a plurality of individual pieces of an edible product;

a connecting flap interconnected to the first and second compartments such that the first and second compartments are pivotable relative to each other along a portion of the connecting flap; and a cover flap, wherein the first compartment comprises a bottom wall, a front wall, a back wall, and an opening disposed oppositely from the bottom wall of the first compartment, wherein the second compartment comprises a bottom wall, a front wall, a back wall, and an opening disposed oppositely from the bottom wall of the second compartment, wherein the back wall of the first compartment and the cover flap are connected to each other along a fold line common to both the back wall of the first compartment and the cover flap, wherein in a closed state of the package the front wall of the first compartment is flush against the front wall of the second compartment, wherein in an open state of the package the second compartment is pivoted relative to the first compartment from the second compartment's position in the closed state, wherein in the open state of the package the opening of the first compartment is oriented in the same direction as the opening of the second compartment, wherein in the closed state of the package the cover flap is selectably positionable such that at least a portion of the cover flap is flush with the back wall of the second compartment, wherein the front wall of the first compartment comprises a first portion, wherein the first portion of the front wall of the first compartment is a single continuous panel of a single layer of paperboard that extends along an entirety of the width of the first compartment, wherein the back wall of the first compartment and the bottom wall of the first compartment are connected to each other along a fold line common to both the back wall of the first compartment and the bottom wall of the first compartment, wherein the back wall of the first compartment extends from the fold line in common with the cover flap to the fold line in common with the bottom wall of the first compartment, wherein the back wall of the first compartment is a single continuous panel of a single layer of paperboard, wherein the back wall of the second compartment and the bottom wall of the second compartment are connected to each other along a fold line common to both the back wall of the second compartment and the bottom wall of the second compartment, wherein the front wall of the first compartment and the bottom wall of the first compartment are connected to each other along a fold line common to both the front wall of the first compartment and the bottom wall of the first compartment, wherein the front wall of the second compartment and the bottom wall of the second compartment are connected to each other along a fold line common to both the front wall of the second compartment and the bottom wall of the second compartment.

6. The package of claim 5, wherein the front wall of the second compartment includes a first portion, wherein the first portion of the front wall of the second compartment is a single continuous panel of a single layer of paperboard that extends along an entirety of the width of the second compartment.

7. The package of claim 5, wherein the back wall of the second compartment is a single continuous panel of a single layer of paperboard, wherein in the closed state of the package the cover flap is selectably positionable such that:

a first portion of the cover flap is flush with an outer surface of the back wall of the second compartment while simultaneously a second portion of the cover flap is flush with an inner surface of the back wall of the second compartment.

8. The package of claim 5, wherein the cover flap is laterally asymmetrical, wherein the package further comprises a receiving slot in the back wall of the second compartment, wherein the receiving slot is offset towards one side so as to be in position to receive an end of the cover flap.

9. The package of claim 5, wherein the fold line common to both the back wall of the first compartment and the cover flap extends along an entirety of the width of the first compartment, wherein the fold line common to both the back wall of the first compartment and the bottom wall of the first compartment extends along an entirety of the width of the first compartment, wherein the fold line common to both the first portion of the front wall of the first compartment and the bottom wall of the first compartment extends along an entirety of the width of the first compartment, wherein the fold line common to both the back wall of the second compartment and the bottom wall of the second compartment extends along an entirety of the width of the second compartment, wherein the fold line common to both the first portion of the front wall of the second compartment and the bottom wall of the second compartment extends along an entirety of the width of the second compartment.

10. The package of claim 5, wherein the first portion of the front wall of the first compartment is adhesively bonded to a second portion of the front wall of the first compartment, wherein the first portion of the front wall of the second compartment is adhesively bonded to a second portion of the front wall of the second compartment.

11. A package for containing pieces of an edible product, comprising:

a first compartment and a second compartment, each compartment being formed to receive and contain a plurality of individual pieces of an edible product;

a connecting flap interconnected to the first and second compartments such that the first and second compartments are pivotable relative to each other along a portion of the connecting flap; and a cover flap, wherein the first compartment comprises a bottom wall, a front wall, a back wall, and an opening disposed oppositely from the bottom wall of the first compartment, wherein the second compartment comprises a bottom wall, a front wall, a back wall, and an opening disposed oppositely from the bottom wall of the second compartment, wherein the back wall of the first compartment and the cover flap are connected to each other along a fold line common to both the back wall of the first compartment and the cover flap, wherein the back wall of the first compartment and the bottom wall of the first compartment are connected to each other along a fold line common to both the back wall of the first compartment and the bottom wall of the first compartment, wherein the back wall of the first compartment extends from the fold line in common with the cover flap to the fold line in common with the bottom wall of the first compartment, wherein the back wall of the first compartment is a single continuous panel of a single layer of paperboard, wherein the back wall of the second compartment and the bottom wall of the second compartment are connected to each other along a fold line common to both the back wall of the second compartment and the bottom wall of the second compartment, wherein the back wall of the second compartment is a single continuous panel of a single layer of paperboard, wherein in a closed state of the package the cover flap is selectably positionable such that a first portion of the cover flap is flush with an outer surface of the back wall of the second compartment while simultaneously a second portion of the cover flap is flush with an inner surface of the back wall of the second compartment, wherein the cover flap is laterally asymmetrical, wherein the package further comprises a receiving slot in the back wall of the second compartment, wherein the receiving slot is offset towards one side so as to be in position to receive an end of the cover flap, wherein the front wall of the first compartment comprises a first portion, wherein the first portion of the front wall of the first compartment is a single continuous panel of a single layer of paperboard that extends along substantially an entirety of the width of the first compartment, wherein the front wall of the second compartment includes a first portion, wherein the first portion of the front wall of the second compartment is a single continuous panel of a single layer of paperboard that extends along an entirety of the width of the second compartment, wherein the first portion of the front wall of the first compartment and the bottom wall of the first compartment are connected to each other along a fold line common to both the first portion of the front wall of the first compartment and the bottom wall of the first compartment, wherein the first portion of the front wall of the second compartment and the bottom wall of the second compartment are connected to each other along a fold line common to both the first portion of the front wall of the second compartment and the bottom wall of the second compartment, wherein a second portion of the front wall of the first compartment is adhesively bonded to a third portion of the front wall of the first compartment, wherein a second portion of the front wall of the second compartment is adhesively bonded to a third portion of the front wall of the second compartment, wherein in the closed state of the package the front wall of the first compartment is flush against the front wall of the second compartment, wherein in an open state of the package the second compartment is pivoted relative to the first compartment from the second compartment's position in the closed state, wherein in the open state of the package the opening of the first compartment is oriented in the same direction as the opening of the second compartment.

* * * * *